United States Patent [19]

Takagi et al.

[11] Patent Number: 4,702,771

[45] Date of Patent: Oct. 27, 1987

[54] WEAR-RESISTANT, SINTERED IRON ALLOY AND PROCESS FOR PRODUCING THE SAME

[75] Inventors: Yoshiaki Takagi, Tsurugashima; Yoshihiro Katsui, Tokyo; Hiroyuki Endo, Abiko; Yutaka Ikenoue, Matsudo, all of Japan

[73] Assignees: Hitachi Powdered Metals Co., Ltd., Matsudo; Honda Giken Kogyo Kabushiki Kaisha, Tokyo, both of Japan

[21] Appl. No.: 848,062

[22] Filed: Apr. 4, 1986

[30] Foreign Application Priority Data

Apr. 17, 1985 [JP] Japan ..... 60-82035

[51] Int. Cl.[4] ..... C22C 29/02; C22C 29/06

[52] U.S. Cl. ..... 75/241; 75/237; 75/246

[58] Field of Search ..... 75/230, 237, 241, 246, 75/126 A, 126 C, 126 E, 126 K, 125; 419/10

[56] References Cited

U.S. PATENT DOCUMENTS

| | | | |
|---|---|---|---|
| 2,165,022 | 7/1939 | Anderson | 75/126 A |
| 2,167,301 | 7/1939 | Jones et al. | 75/126 A |
| 2,171,081 | 8/1939 | Ervin | 75/126 A |
| 3,512,964 | 5/1970 | Fuchsman . | |
| 3,869,037 | 3/1975 | Henry et al. | 148/37 |
| 4,110,514 | 8/1978 | Nicholson | 428/683 |
| 4,168,159 | 9/1979 | Schlatter et al. | 75/126 C |
| 4,253,874 | 3/1981 | Cundill | 75/246 |
| 4,268,309 | 5/1981 | Seriro et al. | 75/230 |
| 4,344,795 | 8/1982 | Endo et al. . | |
| 4,345,943 | 8/1982 | Takahashi et al. | 75/238 |
| 4,394,168 | 7/1983 | Hartrig et al. | 75/126 A |
| 4,422,875 | 12/1983 | Nakata et al. . | |
| 4,485,770 | 12/1984 | Saka et al. . | |
| 4,552,590 | 11/1985 | Nakata et al. . | |
| 4,556,533 | 12/1985 | Oaku et al. | 419/11 |
| 4,588,441 | 5/1986 | Ikenoue et al. . | |

FOREIGN PATENT DOCUMENTS

| | | | |
|---|---|---|---|
| 0099067 | 6/1983 | European Pat. Off. . | |
| 60-165357 | 8/1985 | Japan | 75/237 |
| WO85/01520 | 11/1985 | PCT Int'l Appl. . | |
| 2156851 | 3/1984 | United Kingdom . | |

OTHER PUBLICATIONS

Henderson et al., "Metallurgical Dictionary", 1953, pp. 319–320.

*Primary Examiner*—John F. Terapane
*Assistant Examiner*—Eric Jorgensen
*Attorney, Agent, or Firm*—Armstrong, Nikaido, Marmelstein & Kubovcik

[57] ABSTRACT

Wear-resistant, sintered iron alloys are provided. The alloys have a structure in which iron-based hard particles having a relatively high Cr content and copper or copper alloy particles are dispersed in an iron alloy matrix containing a relatively low content of Cr. The alloys are prepared by compression molding powders of the matrix alloy, the hard alloy, copper or copper alloy, an Fe-P alloy and graphite and sintering the obtained molding at a temperature of 980° to 1130° C.

14 Claims, No Drawings

WEAR-RESISTANT, SINTERED IRON ALLOY AND PROCESS FOR PRODUCING THE SAME

BACKGROUND OF THE INVENTION

1. Field of the Invention

The present invention relates to a sintered alloy having excellent wear and heat resistance and suitable for use as a starting material for a member of a valve mechanism of an internal combustion engine, such as a valve guide.

2. Description of Pertinent Information

Various sintered alloys superior to ingot materials such as ordinary cast iron and cast ferroalloy with respect to wear resistance, machinability and cost and useful as materials for valve guides of internal combustion engines have been developed. The assignees of this application previously developed a sintered alloy comprising an iron matrix containing Cr, Mn and Mo in which free graphite and a steadite phase are dispersed (Japanese Laid-Open Patent Publication No. 177435/1983) and put them into practical use.

However, after the development of said material, a material having a higher wear resistance at a high temperature was demanded since automobile engines having a higher capacity are desired generally and conventional alloys are often unsatisfactory.

SUMMARY OF THE INVENTION

According to the present invention a wear-resistant, sintered iron alloy having improved wear and heat resistance is provided. The alloy is characterized as having an iron matrix containing Cr, Mn and Mo and, dispersed in this matrix, iron-based hard particles having a Cr content higher than that of the matrix to improve the wear and heat resistance of the alloy, and copper or copper alloy (Cu-Sn or Cu-Ni) particles in a non-diffused state to acquire a fit with a member which is contacted with the alloy. If necessary, sulfur is added to the alloy to improve the machinability of a molding of the alloy.

The wear-resistant sintered alloy oF the invention includes the following compositions:

(1) 1.8 to 4% Cr, 0.1 to 1% Mn, 0.07 to 1% Mo, 0.06 to 1.5% P, 1 to 10% Cu or a Cu alloy, 1.5 to 4 % C and, as the balance, Fe:

(2) 1.8 to 4% Cr, 0.1 to 1% Mn, 0.07 to 1% Mo, 0.06 to 1.5% P, 1 to 10% Cu or a Cu alloy, at least one of up to 0.4% W and up to 0.1% V, 1.5 to 4% C and, as the balance, Fe;

(3) 1.8 to 4% Cr, 0.1 to 1% Mn, 0.07 to 1% Mo, 0.06 to 1.5% P, 1 to 10% Cu or a Cu alloy, 0.03 to 0.9% S, 1.5 to 4% C and, as the balance, Fe; and (4) 1.8 to 4% Cr, 0.1 to 1% Mn, 0.07 to 1% Mo, 0.06 to 1.5% P, 1 to 10% Cu or a Cu alloy, at least one of up to 0.4% W and up to 0.1% V, 0.03 to 0.9% S, 1.5 to 4% C and, as the balance, Fe.

Alloys (1), (2), (3) and (4) are produced by compression molding the following mixtures (5), (6), (7) and (8), respectively, and then sintering the resultant moldings at a temperature of from 980° to 1130° C:

(5) (a) an alloy powder comprising 1.8 to 3.5% of Cr, 0.1 to 1% of Mn, 0.1 to 1% of Mo and, as the balance, Fe, (c) 5 to 20% of a hard alloy powder comprising 4 to 10% of Cr, 0.05 to 1% of Mo, 0.2 to 0.7% of P and, as the balance, Fe, (e) 1 to 10% of a copper powder or a copper alloy powder, (f) 0.5 to 5% of an alloy powder comprising Fe and 10-30% of P, and (g) 1.5 to 4% of a graphite powder;

(6) (a) an alloy powder comprising 1.8 to 3.5% of Cr, 0.1 to 1% of Mn, 0.1 to 1% of Mo and, as the balance, Fe, (d) 5 to 20% of a hard alloy powder comprising 4 to 10% of Cr, 0.05 to 1% of Mo, at least one of up to 2% of W and up to 0.5% of V, 0.2 to 0.7% of P and, as the balance, Fe, (e) 1 to 10% of a copper powder or a copper alloy powder, (f) 0.5 to 5% of an alloy powder comprising Fe and 10 to 30% of P, and (g) 1.5 to 4% of a graphite powder;

(7) (b) an alloy powder comprising 1.8 to 3.5% of Cr, 0.1 to 1% of Mn, 0.1 to 1% of Mo, 0.05 to 1% of S and, as the balance, Fe, (c) 5 to 20% of a hard alloy Powder comprising 4 to 10% of Cr, 0.05 to 1% of Mo, 0.2 to 0.7% of P and, as the balance, Fe, (e) 1 to 10% of a copper powder or a copper alloy powder, (f) 0.5 to 5% of an alloy powder comprising Fe and 10 to 30% of P, and (g) 1.5 to 4% of a graphite powder;

(8) (b) an alloy powder comprising 1.8 to 3.5% of Cr, 0.1 to 1% of Mn, 0.1 to 1% of Mo, 0.05 to 1% of S and, as the balance, Fe, (d) 5 to 20% of a hard alloy powder comprising 4 to 10% of Cr, 0.05 to 1% of Mo, at least one of up to 2% of W and up to 0.5% of V, 0.2 to 0.7% of P and, as the balance, Fe, (e) 1 to 10% of a copper powder or a copper alloy powder, (f) 0.5 to 5% of an alloy powder comprising Fe and 10 to 30% of P, and (g) 1.5 to 4% of a graphite powder.

DESCRIPTION OF PREFERRED EMBODIMENTS

The present invention is described below in conjunction with particular embodiments thereof.

Starting powders were prepared and included a copper powder having a particle size of up to 200 mesh, a bronze powder (10% Sn), an Fe-20P alloy powder, a natural graphite powder, matrix alloy powders a and b and hard alloy powders c and d. These powders had the compositions described below. A matrix alloy powder h, as a conventional material, was also prepared. The alloy powders had the following compositions:

(a) 2% of Cr, 0.7% of Mn, 0.2% of Mo and the balance Fe, (b) 2% of Cr, 0.7% of Mn, 0.2% of Mo, 0.2% of S and the balance Fe, (h) 0.8% of Cr, 0.7% of Mn, 0.2% of Mo and the balance Fe, (c) 5% of Cr, 0.45% of Mo, 0.45% of P and the balance Fe, and (d) 5% of Cr, 0.45% of Mo, 0.45% of P, 1.7% of W, 0.1% of V and the balance Fe.

These powders were used to prepare sample alloys using the process which is described below in conjunction with the preparation of a conventional alloy: 5% of a copper powder, 1.25% of an Fe-P powder and 2% of a graphite powder were added to the matrlx alloy powder h. 1% of zinc stearate as a lubricant was added thereto and mixed thoroughly. The powdery mixture was shaped into test pieces of a given shape under a molding pressure of 6 t/cm$^2$ and sintered at 1060° C. in a cracked ammonia gas atmosphere in a furnace for 30 min to obtain a sample which is identified as Sample No. 18 in the following Tables 1 and 2. This sample had a sinter density of 6.70 g/cm$^3$.

Additional samples identified as Sample Nos. 1 to 17 in Tables 1 and 2 were prepared in the same manner as above except that the starting powders were used in the amounts shown in Table 1. The numbers 1 to 8 in the column of Remarks in Table 1 refer to alloy Nos. 1 to 4 and the process mixture Nos. 5 to 8, respectively, of the present invention described above. For example, the process for producing the sample No. 17 is that using mixture No. 5 and the alloy composition is that of alloy No. 1 above.

The chemical compositions of the obtained alloy sample Nos. 1 to 18 are shown in Table 2. In case the composition or the process conditions of a sample is not within the given range of the invention, this fact is indicated by identifying the sample as a "comparative example" in the column of the Remarks in Tables 1 and 2.

The alloy samples were subjected to wear resistance and machinability tests.

In the wear resistance test, an Ogoshi's frictional wear tester was used. The sample was pressed against an SUH-3 rotor having a diameter of 30 mm and a width of 3 mm rotating at a peripheral speed of 3.6 m/sec under a load of 12.6 kg in air at 400° C. and the abrasion wear of the sample after 400 m sliding without lubrication was measured. The abrasion wear was indicated in terms of an index on the basis of the abrasion wear (expressed as 100) of the conventional sample No. 18. The lower the index, the higher and better the wear resistance.

Machinability is a property which is essentially contradictory to wear resistance. However, machinability is quite important for factory workers, since this property exerts a great influence on operation efficiency in the steps of processing the sintered members and mounting the same on the engine. In the machinability test, a cylindrical sample having a length of 40 mm and an inner diameter of 7.4 mm was reamed to increase the inner diameter to 8 mm and time required for the reaming was measured. The time was indicated in terms of an index on the basis of the time (expressed as 100) required for the reaming of the sample No. 18. The lower the index, the shorter the processing time, i.e., the better the machinability.

The test results are shown in the right column of Table 1. The properties of the sample Nos. 3 and 6 were the best of all of the samples.

The results shown in Table 1 are discussed below in conjunction with the choice of conditions and compositions of the alloys. The composition of the conventional sample No. 18 was the same as that of the sample No. 1 except for the powdery alloy constituting the iron matrix. The properties of sample No. 1 were slightly better than those of sample No. 18 because the matrix alloy powder of the former has a high Cr content and, in addition, contains sulfur. However, the low wear resistance of sample No. 1 is far from the wear resistance levels demanded nowadays.

The sample Nos. 1 to 4 show the effects of the hard alloy powder having a high Cr content and being dispersed in the matrix. When 5% or more of this alloy powder is used, the wear resistance is improved remarkably, while the machinability is reduced slightly. The wear is minimized with about 10% of said alloy powder. As the amount of this alloy powder is increased further, both machinability and wear resistance are reduced. The upper limit of the amount thereof is, therefore, about 20%.

The sample No. 16 made from a sulfur-free matrix alloy powder has a nearly equal wear resistance but inferior machinability to those of the sample No. 3. This fact is also demonstrated in sample Nos. 15 and 17 containing another hard alloy powder.

Though the significant effects of sulfur on the machinability of the matrix can be obtained even in a very small amount in the matrix alloy powder of 0.05%, a sulfur content of around 0.2% is preferred. The upper limit of the sulfur content of the matrix powder is 1% based on the matrix alloy, since excessive sulfur invites a reduction in the strength of the matrix.

Sample Nos. 3, 5 and 6 show the influence of copper dispersed in a non-diffused state in the iron matrix. The wear of sample Nos. 3 and 6 is less than that of copper-free sample No. 5. The effect of copper is obtained with copper in an amount of at least 1%. The effects obtained with 1 to 10% of copper are substantially equivalent. The upper limit of the amount of copper is 10%, however, from the standpoint of the dimensional stability of the product, since the extent of expansion in the sintering step is increased as the amount of copper is increased.

Sample No. 7 which is the same as sample No. 3 but which contains a bronze powder (tin content: 10%) in place of copper powder has a wear resistance substantially equal to that of sample No. 3. The former has a machinability slightly lower than that of the latter probably because copper is diffused under the influence of tin. Thus, copper alloys such as 8 to 11% Sn-Cu and 5 to 30% Ni-Cu can be regarded to function essentially the same as copper so far as the purpose of the present invention is concerned. It is important to maintain copper in a non-diffused state. Therefore, sintering of the alloy powders is effected at a temperature of up to 1130° C. and at least 980° C., that is, the lower limit of the temperature necessitated for sintering of the matrix.

Sample Nos. 8 to 11 show the influence of phosphorus incorporated therein in the form of an Fe-P alloy powder. Commercially available Fe-P alloy powders have a phosphorus content of usually 10 to 30%. When this alloy powder is incorporated in the matrix, an Fe-P-C compound is formed in the sintering step to form a liquid phase and, therefore, sintering is accelerated and a part thereof is converted into a steadite phase to reinforce the matrix. The machinability, however, is reduced slightly. The wear resistance is improved sharply with at least 0.5% of the Fe-P alloy powder. The maximum wear resistance is obtained with 1 to 1.5% thereof and this resistance is reduced as the amount of this alloy powder is increased. With more than 5% of the Fe-P alloy powder, the matrix becomes brittle and both machinability and wear resistance of the product are reduced as evidenced by the properties in sample No. 11. Thus, the amount of the Fe-P alloy powder used should be 0.5 to 5%.

Sample Nos. 12 to 14 show the influence of carbon used in the form of graphite. With 0.3% thereof, the intended high wear resistance cannot be obtained, though good machinability is obtained. With 3.3% thereof, the wear resistance is kept at a high level, while the machinability is reduced slightly.

The behavior of carbon incorporated in the alloy is considerably complicated. It exhibits various effects such as promotion of the formation of a solid solution of the iron matrix, the formation of carbides of added elements, the acceleration of sintering by reaction with Fe-P and solid lubrication which is realized when the carbon is in the form of free graphite. The minimum amount of carbon necessary for exhibiting the above-mentioned effects is 1.5% and the optimum amount thereof is around 2% as shown by the properties of sample No. 3. The upper limit of carbon is 4%, since an excessive amount thereof invites segregation of the powder and reduction in moldability.

Sample No. 15 contains W- and V-free hard alloy powders. Although sample No. 15 has practicable properties, it is apparent from a comparison with the data for sample No. 3 that the wear resistance thereof is further improved by W and V. This fact applies also to sample Nos. 16 and 17. This phenomenon occurs because W and V react with carbon to form hard carbides and, therefore, to increase the hardness of the hard alloy phase. However, when the W and V contents are in excess, the alloy is liable to damage a member brought into contact therewith. Therefore, the W and V contents of the hard alloy powder should be controlled to up to 2% and up to 0.5%, respectively.

The influence of the other components of the matrix alloy powder used as the main starting material and of the hard alloy Powder is as follows.

Cr: Cr contained in both the matrix alloy powder and the hard alloy powder forms its carbide which improves the wear resistance and oxidation resistance of the alloy. However, when it is distributed homogeneously over the entire alloy in an even concentration, the desired properties of the alloy cannot be obtained. The present invention is characterized, therefore, in that the Cr content of the matrix is controlled to be low, i.e., 1.8 to 3.5%, so as to maintain toughness and a hard alloy phase having a higher Cr content of 4 to 10% is dispersed in the matrix.

When the Cr content of the alloy powder is less than 1.8%, a sufficient effect of Cr cannot be obtained, while when it exceeds 10%, the powder becomes hard and the moldability thereof is damaged.

Mo: Mo contained in both the matrix alloy powder and hard alloy powder has an effect similar to that of Cr and, in addition, improves the strength and wear resistance at high temperatures. The significant effect thereof is obtained with at least 0.1% thereof in the matrix alloy powder having the low Cr content and with at least only 0.05% thereof in the hard alloy powder having the high Cr content. When Mo is used in an amount exceeding 1%, the effect is not improved further but rather the machinability of the powder is damaged.

Mn: Mn incorporated in the matrix alloy powder having the low Cr content reinforces the iron matrix. With less than 0.1% of Mn, the effects thereof cannot be obtained, while when the amount thereof exceeds 1%, a problem of oxidation occurs in the sintering step.

Phosphorus: phosphorus is incorporated in the hard alloy powder so as to further increase the hardness of the hard alloy powder. The significant effect of phosphorus is obtained with at least 0.2% thereof. When the amount of phosphorus exceeds 0.7%, the alloy powder becomes brittle to deteriorate the compressibility.

The respective total compositions of the alloys of the present invention are inducible, or derived, from the contents of the starting materials used in the process of the invention.

TABLE 1

| Sample | Matrix alloy powder | | | Hard alloy powder | | Copper powder | Bronze | Fe—P | Graphite | Sinter density | Abrasion wear | Machinability | |
|---|---|---|---|---|---|---|---|---|---|---|---|---|---|
| No. | a. | b. | h. | c. | d. | e. | e. | f. | g. | g/cm$^3$ | index | index | Remarks |
| 1 | — | 91.75 | — | — | — | 5 | — | 1.25 | 2.0 | 6.70 | 91 | 96 | Comparative example |
| 2 | — | 86.75 | — | — | 5 | 5 | — | 1.25 | 2.0 | 6.65 | 62 | 100 | 8, 4 |
| 3 | — | 81.75 | — | — | 10 | 5 | — | 1.25 | 2.0 | 6.65 | 52 | 102 | " |
| 4 | — | 71.75 | — | — | 20 | 5 | — | 1.25 | 2.0 | 6.60 | 58 | 105 | " |
| 5 | — | 86.75 | — | — | 10 | — | — | 1.25 | 2.0 | 6.50 | 75 | 98 | Comparative example |
| 6 | — | 76.75 | — | — | 10 | 10 | — | 1.25 | 2.0 | 6.65 | 53 | 103 | 8, 4 |
| 7 | — | 81.75 | — | — | 10 | — | 5 | 1.25 | 2.0 | 6.65 | 53 | 105 | " |
| 8 | — | 82.85 | — | — | 10 | 5 | — | — | 2.0 | 6.55 | 87 | 94 | Comparative example |
| 9 | — | 82.5 | — | — | 10 | 5 | — | 0.5 | 2.0 | 6.60 | 57 | 103 | 8, 4 |
| 10 | — | 78 | — | — | 10 | 5 | — | 5.0 | 2.0 | 6.70 | 60 | 107 | " |
| 11 | — | 74 | — | — | 10 | 5 | — | 9.0 | 2.0 | 6.70 | 84 | 130 | Comparative example |
| 12 | — | 83.45 | — | — | 10 | 5 | — | 1.25 | 0.3 | 6.70 | 70 | 93 | " |
| 13 | — | 82.25 | — | — | 10 | 5 | — | 1.25 | 1.5 | 6.65 | 54 | 98 | 8, 4 |
| 14 | — | 80.45 | — | — | 10 | 5 | — | 1.25 | 3.3 | 6.58 | 54 | 105 | " |
| 15 | — | 81.75 | — | 10 | — | 5 | — | 1.25 | 2.0 | 6.65 | 64 | 103 | 7, 3 |
| 16 | 81.75 | — | — | — | 10 | 5 | — | 1.25 | 2.0 | 6.65 | 53 | 107 | 6, 2 |
| 17 | 81.75 | — | — | 10 | — | 5 | — | 1.25 | 2.0 | 6.65 | 63 | 106 | 5, 1 |
| 18 | — | — | 91.75 | — | — | 5 | — | 1.25 | 2.0 | 6.70 | 100 | 100 | Conventional example |

TABLE 2

| Sample | Chemical composition of sample (%) | | | | | | | | | | | |
|---|---|---|---|---|---|---|---|---|---|---|---|---|
| No. | C | Cr | Mn | Mo | Cu | Sn | P | S | W | V | Fe | Remarks |
| 1 | 1.8 | 1.84 | 0.64 | 0.18 | 5 | — | 0.25 | 0.18 | — | — | Bal | Comparative example |
| 2 | " | 1.99 | 0.61 | 0.20 | 5 | — | 0.27 | 0.17 | 0.09 | 0.01 | " | 4, 8 |
| 3 | " | 2.14 | 0.57 | 0.21 | 5 | — | 0.30 | 0.16 | 0.17 | 0.01 | " | " |
| 4 | " | 2.44 | 0.50 | 0.23 | 5 | — | 0.34 | 0.14 | 0.34 | 0.02 | " | " |

TABLE 2-continued

| Sample No. | Chemical composition of sample (%) C | Cr | Mn | Mo | Cu | Sn | P | S | W | V | Fe | Remarks |
|---|---|---|---|---|---|---|---|---|---|---|---|---|
| 5 | " | 2.24 | 0.61 | 0.22 | — | — | 0.30 | 0.17 | 0.17 | 0.01 | " | Comparative example |
| 6 | " | 2.04 | 0.54 | 0.20 | 10 | — | 0.30 | 0.15 | 0.17 | 0.01 | " | 4, 8 |
| 7 | " | 2.14 | 0.57 | 0.21 | 4.5 | 0.5 | 0.30 | 0.16 | 0.17 | 0.01 | " | " |
| 8 | " | 2.16 | 0.58 | 0.21 | 5 | — | 0.05 | 0.17 | 0.17 | 0.01 | " | Comparative example |
| 9 | " | 2.15 | 0.58 | 0.21 | 5 | — | 0.15 | 0.17 | 0.17 | 0.01 | " | 4, 8 |
| 10 | " | 2.06 | 0.55 | 0.20 | 5 | — | 1.05 | 0.16 | 0.17 | 0.01 | " | " |
| 11 | " | 1.98 | 0.52 | 0.19 | 5 | — | 1.85 | 0.15 | 0.17 | 0.01 | " | Comparative example |
| 12 | 0.3 | 2.17 | 0.58 | 0.21 | 5 | — | 0.30 | 0.17 | 0.17 | 0.01 | " | " |
| 13 | 1.4 | 2.15 | 0.58 | 0.21 | 5 | — | 0.30 | 0.17 | 0.17 | 0.01 | " | 4, 8 |
| 14 | 3.0 | 2.11 | 0.56 | 0.21 | 5 | — | 0.30 | 0.16 | 0.17 | 0.01 | " | " |
| 15 | 1.8 | 2.14 | 0.57 | 0.21 | 5 | — | 0.30 | 0.16 | — | — | " | 3, 7 |
| 16 | " | 2.14 | 0.57 | 0.21 | 5 | — | 0.30 | — | 0.17 | 0.01 | " | 2, 6 |
| 17 | " | 2.14 | 0.57 | 0.21 | 5 | — | 0.30 | — | — | — | " | 1, 5 |
| 18 | " | 0.73 | 0.64 | 0.18 | 5 | — | 0.25 | — | — | — | " | Conventional example |

Even though a very small amount of Mn might be contained in the hard alloy powder and a small amount of Si may be used in the production of the alloy powder so as to improve the flowability of the molten metals, both Mn and Si may be regarded as impurities in the present invention.

As described above in detail, the sintered alloy of the present invention is significantly better than alloys used ordinarily in the production of a member of a valve mechanism and its properties fully satisfy the present requirements for automobile engines. The alloys of the invention are different from one another with respect to wear resistance, machinability and cost. They must be selected suitably according to the intended properties of the engine. Also, although the description of the invention has been made above with reference to the use of the alloy for the production of valve guides, the alloy may also be used in the production of other members of valve mechanisms such as valve seats.

We claim:

1. A wear-resistant, sintered iron alloy having a composition comprising, by weight: 1.8 to 4% or Cr, 0.1 to 1% of Mn, 0.07 to 1% of Mo, 0.06 to 1.5% of P, 1 to 10% of Cu or a Cu alloy, 1.5 to 4% of C and, as the balance, Fe; the structure of the alloy comprising an iron-based alloy matrix containing Cr, Mn and Mo therein, iron-based hard particles having a Cr content higher than that of the matrix and being dispersed as a hard alloy phase in said matrix, and copper or copper alloy particles which are dispersed in said matrix in a non-diffused state.

2. The alloy of claim 1 further comprising at least one metal of the group consisting of W, in an amount of up to 0.4%, and V, in an amount of up to 0.1%.

3. The alloy of claim 2 wherein the Cu alloy is a Cu-Sn or Cu-Ni alloy.

4. The alloy of claim 1 further comprising 0.03 to 0.9% of S.

5. The alloy of claim 1 wherein the Cu alloy is a Cu-Sn or Cu-Ni alloy.

6. The alloy of claim 1 further comprising at least one element selected from the group consisting of W in an amount of up to 0.4%, and, V, in an amount of up to 0.1%, and S, in an amount between 0.03 and 0.9%.

7. The alloy of claim 6 wherein the Cu alloy is a Cu-Sn or Cu-Ni alloy.

8. The alloy of claim 1 wherein the Cu alloy is a Cu-Sn or Cu-Ni alloy.

9. A valve guide for an internal combustion engine formed from an alloy according to claim 1.

10. A wear-resistant, sintered iron alloy having a composition consisting essentially of, by weight: 1.8 to 4% of Cr, 0.1 to 1% of Mn, 0.07 to 1% of Mo, 0.06 to 1.5% of P, 1 to 10% of Cu or a Cu alloy, 1.5 to 4% of C and, as the balance, Fe; the structure of the alloy comprsing an iron-based alloy matrix containing Cr, Mn and Mo therein, iron-based hard particles having a Cr content higher than that of the matrix and being dispersed as hard alloy phase in said matrix, and copper or copper alloy particles which are dispersed in said matrix in a non-diffused state.

11. A wear-resistant sintered iron alloy having a structure comprising an iron-based alloy matrix containing Cr, Mn and Mo therein, iron-based hard particles having a Cr content higher than that of the matrix and dispersed as a hard alloy phase in said matrix, a copper or copper alloy particles dispersed in a matrix in a non-diffused state, produced by the process comprising compression molding a mixture of, based on the weight of the mixture:

(i) an iron-based alloy powder as said matrix comprising 1.8 to 3.5% of Cr, 0.1 to 1% of Mn, 0.1 to 1% of Mo and, as the balance, Fe, (ii) 5 to 20% of an iron-based hard alloy powder as said hard alloy phase comprising 4 to 10% of CR, 0.05 to 1% of Mo, 0.2 to 0.7% of P and, as the balance Fe, (iii) 1 to 10% of a copper powder or a copper alloy powder, (iv) 0.5 to 5% of an alloy powder comprising Fe and 10–30% of P, and (v) 1.5 to 4% of a graphite powder; and sintering the resultant molding at a temperature of 980° to 1130° C.

12. A wear-resistant sintered iron alloy having a structure comprising an iron-based alloy matrix containing Cr, Mn and Mo therein, iron-based hard particles having a Cr content higher than that of the matrix and dispersed as a hard alloy phase in said matrix, and copper or copper alloy particles dispersed in the matrix in a non-diffused state, produced by the process comprising compression molding a mixture of, based on the weight of the mixture:

(i) an iron-based alloy powder as said matrix comprising 1.8 to 3.5% of Cr, 0.1 to 1% of Mn, 0.1 to 1% of Mo and, as the balance, Fe, (ii) 5 to 20% of an iron-based hard alloy powder as said hard alloy phase comprising 4 to 10% of Cr, 0.05 to 1% of Mo, at least one element selected from the group consisting of W in an amount up to 2%, V in an amount of up to 0.5%, P in an amount of 0.2 to 0.7% and, as the balance Fe, (iii) 1 to 10% of a copper powder or a copper alloy powder, (iv) 0.5 to 5% of an alloy powder comprising Fe and 10–30% of P, and (v) 1.5 to 4% of a graphite powder; and sintering the resultant molding at a temperature of 980° to 1130° C.

13. A wear-resistant sintered iron alloy having a structure comprising an iron-based alloy matrix containing Cr, Mn and Mo therein, iron-based hard particles having a Cr content higher than that of the matrix and dispersed as a hard alloy phase in the matrix, and copper or copper alloy particles dispersed in the matrix in a non-diffused state, produced by the process comprising compression molding a mixture, based on the weight of the mixture;

(i) an iron-based alloy powder as said matrix comprising 1.8 to 3.5% of Cr, 0.1 to 1 % of Mn, 0.1 to 1% of Mo, 0.05 to 1% of S and, as the balance Fe, (ii) 5 to 20% of an iron-based hard alloy powder as said hard alloy phase comprising 4 to 10% of Cr, 0.05 to 1% of Mo, 0.2 to 0.7% of P and, as the balance, Fe, (iii) 1 to 10% of a copper powder or a copper alloy powder, (iv) 0.5 to 5% of an alloy powder comprising Fe and 10 to 30% of P, and (v) 1.5 to 4% of a graphite powder; and sintering the resultant molding at a temperature of 980° to 1130° C.

14. A wear-resistant sintered iron alloy having a structure comprising an iron-based alloy matrix containing Cr, Mn and Mo therein, iron-based hard particles having a Cr content higher than that of the matrix and dispersed as a hard alloy phase in said matrix, and copper or copper alloy particles dispersed in the matrix in a non-diffused state, produced by the process comprising compression molding a mixture of, based on the weight of the mixture:

(i) an iron-based alloy powder as said matrix comprising 1.8 to 3.5% of Cr, 0.1 to 1% of Mn, 0.1 to 1% of Mo, 0.05 to 1% of S and, as the balance, Fe;

(ii) 5 to 20% of an iron-based hard alloy powder as said hard alloy phase comprising 4 to 10% of Cr, 0.05 to 1% of Mo, at least one element selected from the group consisting of W, in an amount of up to 2%, V, in an amount of up to 0.5%, P in an amount of 0.2 to 0.7% and, as the balance, Fe;

(iii) 1 to 10% of a copper powder or copper alloy powder;

(iv) 0.5 to 5% of an alloy powder comprising Fe and 10 to 30% of P; and (v) 1.5 to 5% of a graphite powder; and sintering the resultant molding at a temperature of 980° to 1130° C.

* * * * *

UNITED STATES PATENT AND TRADEMARK OFFICE

CERTIFICATE OF CORRECTION

PATENT NO. : 4,702,771

DATED : October 27, 1987

INVENTOR(S) : Yoshiaki TAKAGI et al

It is certified that error appears in the above-identified patent and that said Letters Patent is hereby corrected as shown below:

Claim 14, Column 10, Line 24, "1.5 to 5%" should read --1.5 to 4%--.

Signed and Sealed this

Thirty-first Day of May, 1988

*Attest:*

*Attesting Officer*

DONALD J. QUIGG

*Commissioner of Patents and Trademarks*